United States Patent [19]

Kim

[11] Patent Number: 4,696,077

[45] Date of Patent: Sep. 29, 1987

[54] HANDLE ASSEMBLY FOR LUGGAGE CASE

[75] Inventor: Hyun S. Kim, New Castle, Pa.

[73] Assignee: Airway Industries, Inc., Ellwood City, Pa.

[21] Appl. No.: 868,099

[22] Filed: May 29, 1986

[51] Int. Cl.[4] ..... A47B 95/02

[52] U.S. Cl. ..... 16/125; 150/110

[58] Field of Search ..... 16/115, 116 R, 114 B, 16/125, 129, 119; 190/39, 115; 150/107, 110

[56] References Cited

U.S. PATENT DOCUMENTS

| | | | |
|---|---|---|---|
| 195,132 | 9/1877 | Hopfensack | 150/110 |
| 778,060 | 12/1904 | Moore | 190/115 |
| 3,425,470 | 2/1969 | Wuest | 150/110 |
| 3,700,160 | 10/1972 | Farrell | 16/125 |
| 3,736,621 | 6/1973 | Szabo | 16/116 |
| 4,134,480 | 1/1979 | Davis | 16/115 |

FOREIGN PATENT DOCUMENTS

| | | | |
|---|---|---|---|
| 2937786 | 4/1981 | Fed. Rep. of Germany | 190/115 |

*Primary Examiner*—M. Jordan

*Attorney, Agent, or Firm*—Walter J. Blenko, Jr.; Suzanne Kikel

[57] ABSTRACT

A handle assembly for a luggage case having a hand-grip member made of a heavy cord of twisted material formed into two rows longitudinally and closely spaced together with an outer piece of fabric material folded around and sewn along the central longitudinal line to provide a substantially central portion of said element. A piece of leather may be folded over said heavy cord of material underlying the fabric material and sewn along the central longitudinal line. In addition, a length of strap may be arranged along the length of the hand-grip member to add rigidity thereto. A piece of leather is brought through a loop and fixedly attached to the ends of the hand-grip member, and a fabric piece of material is brought through the other side of the loop to form an anchoring portion for attachment to the luggage case.

6 Claims, 9 Drawing Figures

HANDLE ASSEMBLY FOR LUGGAGE CASE

This invention relates to a handle assembly for a luggage case, and has particular relation to a hand-grip member forming a central part of the assembly, which is flexibly deformable into an arched or curved semi-rigid contour for use in carrying a luggage case. A method for and construction of the hand grip member is such that it provides an easily grippable, flexible central area, which is comfortable for the carrier to handle.

Handles or hand-grip members attached to a luggage case for carrying the luggage case are customarily of a rigid arched or curved contour convenient for the grasp by the hand of the carrier. Sometimes the hand-grip member is padded or of a resilient material or composition to protect the hands of the carrier. Alternately, the handle or hand grip member is made of leather or vinyl which may tend to cause the hand to sweat under prolonged periods of time. The folding and stitching of the material of the hand grip member may be such as to be uncomfortable and irritable to the hand and fingers under heavy loads and/or extended periods of time.

In the prior U.S. Pat. No. 4,134,480 to Michael Davis a handle assembly with a hand-grip member is disclosed in which a leather or vinyl strap is folded longitudinally into multiple layers which gives a padding effect and has contoured protrusions along its longitudinal edges. However, the construction is such that it is bulky, and the width is generally narrow not providing enough surface area for ease of grasping and comfort in carrying the luggage case.

I provide a handle assembly for a luggage case having a hand-grip member which is deformable into an arched or curved contour, for ease of accessibility and grasping by the hand, and which is of a flexible padded composition and construction such that it cushions the hands of the carrier, absorbs the sweat, and is comfortable to the hand and fingers.

More specifically, I provide a handle assembly for a luggage case comprising a hang-grip member in which in one preferred embodiment at least two rows of a heavy cord of fiber are enwrapped with an outer interweaved absorbing material and stitched down through the center of the two rows to form generally contoured protrusions easily and comfortably enwrapped by the fingers and substantially grippable by the hand.

I broadly provide a relatively simple manner of construction for a handle assembly for a luggage case which reduces the labor costs and which at the same time is decorative and attractive in appearance, in that it complements and is coordinated with the luggage case.

Optionally, I further provide an intermediate enwrapping piece of leather material and/or a length of leather spanning the gap formed by the two rows of corded fiber which add padding and rigidity to the hand-grip member. For attachment to a loop, a piece of leather or laminated material is brought therethrough and sewn to the opposed ends of the assembled hand-grip member. At the other side of the loop, a metal bracket is overlain with a piece of fabric and leather forming an anchoring portion for the handle assembly on the luggage case.

More specific details of the structure and method of making a handle assembly of my invention are described hereinafter in relation to the accompanying drawings.

Figure 1:
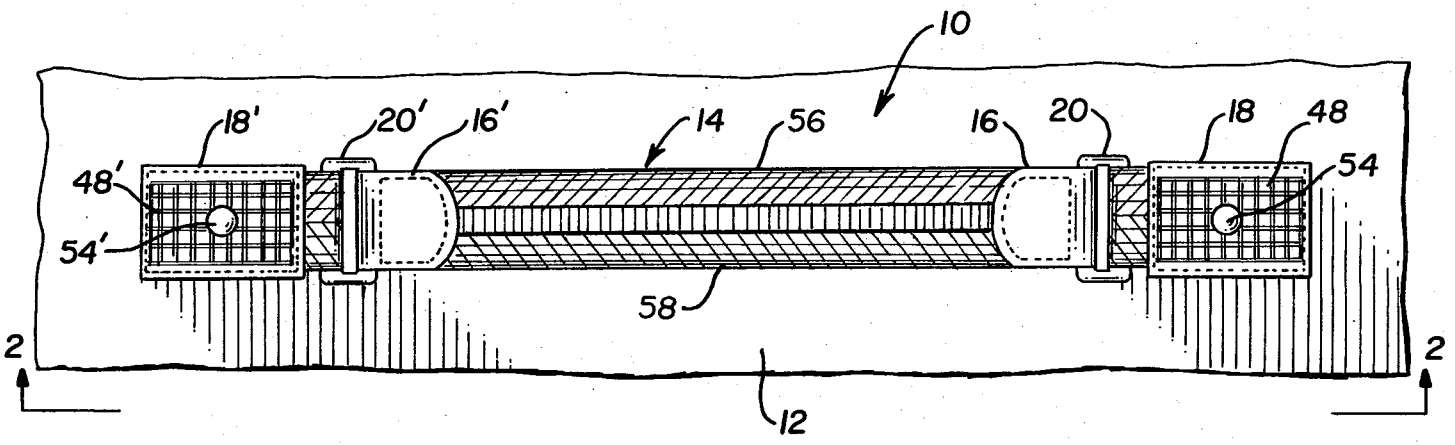
FIG. 1 is a plan view of a handle assembly, attached to a luggage case.
Figure 2:
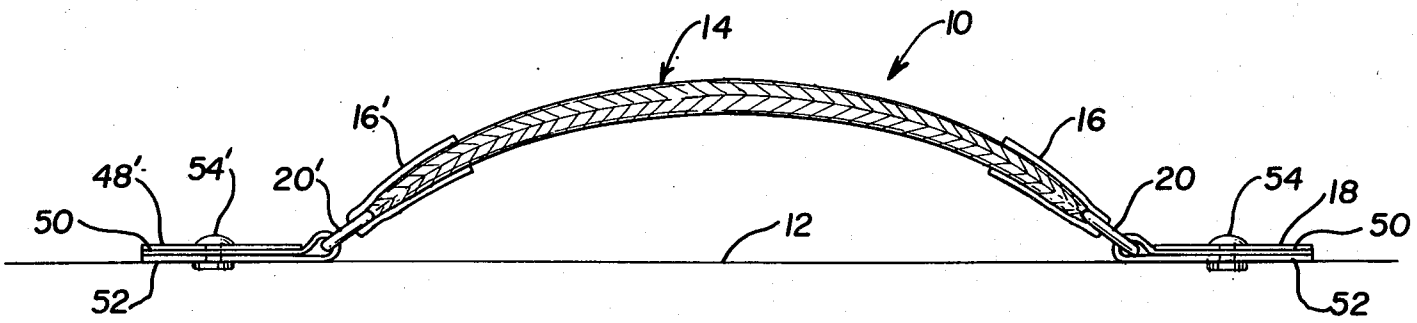
FIG. 2 is an elevational view taken along line 2—2 of FIG. 1 of a handle assembly attached to a luggage case.

Referring first to FIGS. 1 and 2, there is shown a handle assembly 10 secured by way of riveting to a top wall of the frame of the body portion of the luggage case 12, which is broken away for brevity. Handle assembly 10 comprises a central portion or hand-grip element 14, two identical attachment tabs 16 and 16', two identical anchoring tabs 18 and 18' and two identical rectangular plastic loops 20 and 20' for connecting opposite ends of the hand-grip member 14 to the respective attachment tabs and anchoring tabs.

Figure 3:
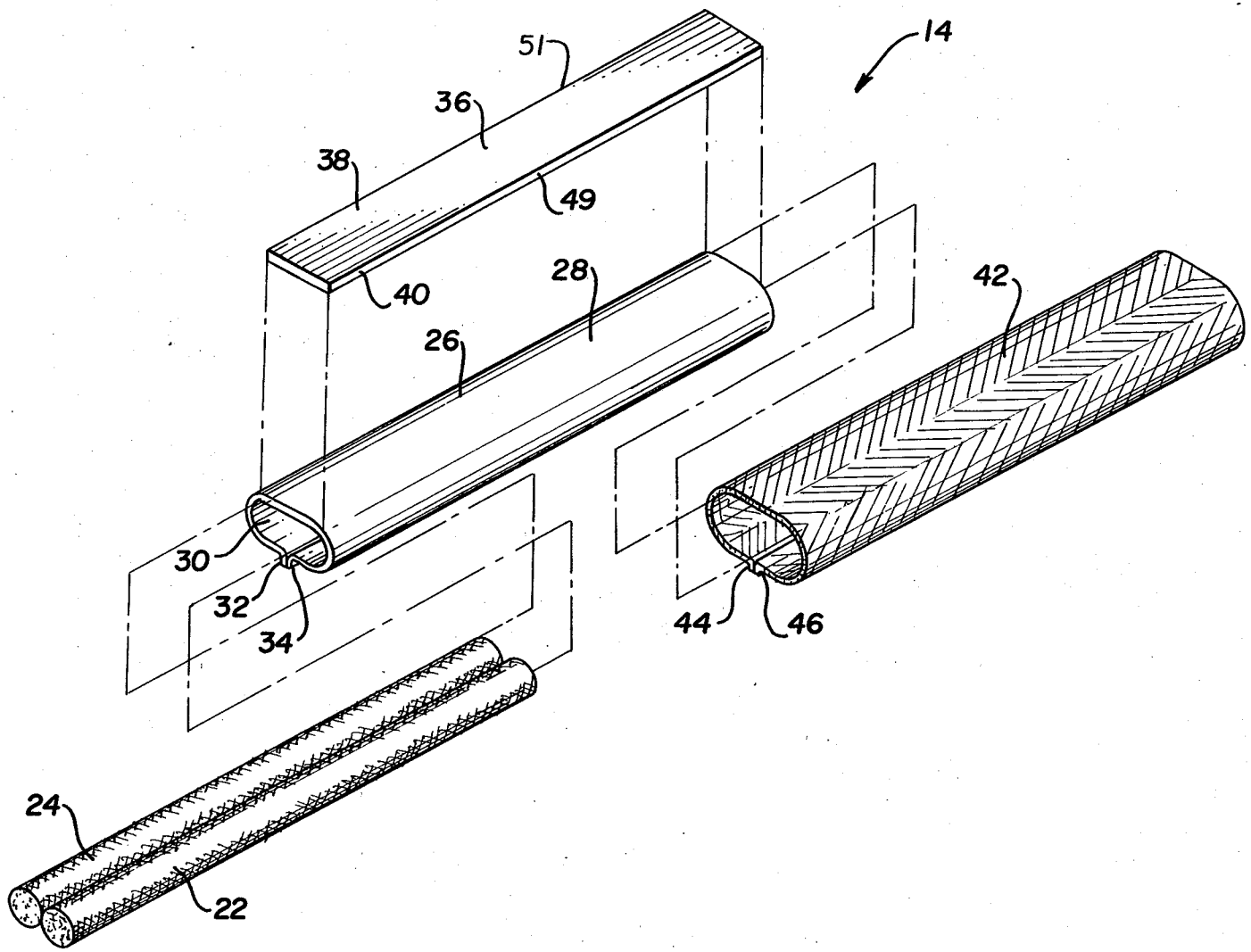
FIG. 3 is an exploded isometric view illustrating the main components some of which or all of which may comprise a hand-grip member.

Referring now to FIG. 3, it will be seen that several components are assembled in the manner indicated to form a hand-grip member 14. It is to be understood that all or some of these components may be assembled thereby constituting the several preferred embodiments of the present invention. These components are basically of different fabric materials of substantially the same length, and will be discussed with respect to the inner to the outer layer of fabrics for the hand-grip member 14. Two longitudinal rows 22, 24 of a flexible, heavy cord of twisted material such as a rope are arranged to form the inner core. Rows 22 and 24 are closely spaced together forming a longitudinal centerline for the hand-grip member 14. The heavy cord of twisted material is compressible to the extent the hand-grip member 14 can be displaced into a relatively flat disposition.

An intermediate piece 26 of flexible material made of either leather or of a laminated material with a plastic outer covering 28 and a composite rubber backing 30 is enwrapped around rows 22 and 24 to give rigidity and durability to the hand-grip member 14. The longitudinal edges 32, 34 thereof are bent downwardly and brought together to be sewn along the longitudinal centerline thereof. For added rigidity and durability there is provided a separate strap member 36 of a flexible material arranged along and on the top outer surface of intermediate piece 26.

Strap member 36 is of a suitable length and made of either leather or of a laminated material with a plastic outer covering 38 and a composite rubber backing 40.

An outer piece of fabric material 42 is arranged around the previously mentioned remaining three components with its longitudinal edges 44, 46 coming together in a similar manner to that of intermediate piece 26 and sewn together to form a longitudinal centerline corresponding to that of the assembled three entities i.e., the heavy corded material, intermediate piece 26 and strap 36.

The type of fabric for outer piece 42 is of the absorbent type, and may be the same shade as or of a complementary shade relative to luggage case 12.

Figure 4:
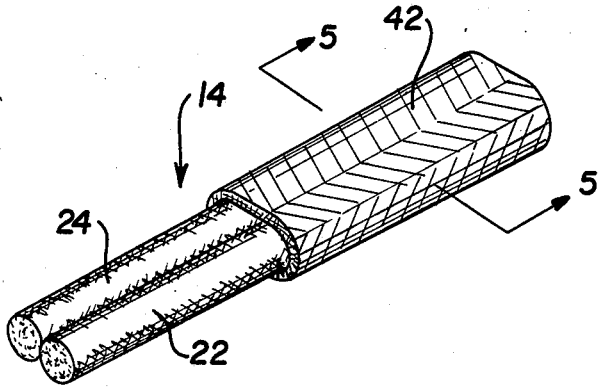
FIG. 4 is an isometric view of a first preferred embodiment of the invention in a telescopic arrangement.
Figure 5:
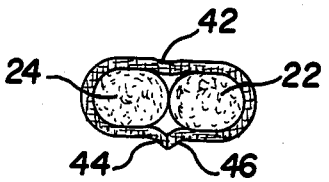
FIG. 5 is a cross-sectional view of FIG. 4.

FIGS. 4–9 illustrate the various embodiments of the invention. It is to be appreciated that these are telescopic views and that the components are brought together so that their ends are aligned relative to each other. As can be seen, the hand-grip member 14 of FIGS. 4 and 5 illustrating a first embodiment consists of the two rows 22, 24 of corded material and outer fabric material 42. In constructing this embodiment, the two rows 22 and 24 of corded fabric are sized along with the outer piece of material 42, and arranged on the inner side of outer piece 42. Outer piece is folded over and around the corded fabric with the longitudinal edges upsetting outwardly to abut each other to an extent they can be sewn together along an under side of the hand-grip member 14 as shown in FIG. 5. The corded fabric 22, 24 and outer piece 42 are made to be integral relative to each other by squeezing the top and under surfaces of outer piece 42 together (FIG. 5) and making several rows of stitches along either side of the longitudinal edges 44, 46 along a longitudinal centerline thereof thereby securing the top surfaces and the under surfaces together.

Figure 6:
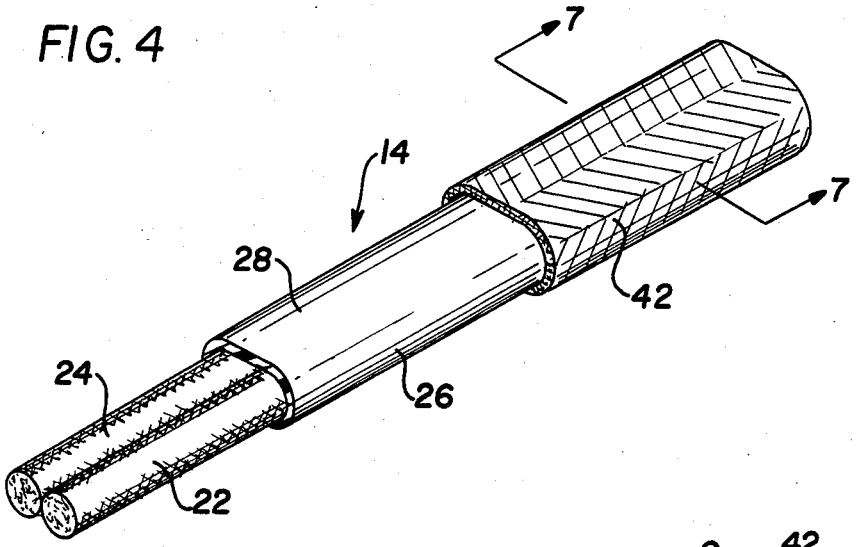
FIG. 6 is an isometric view of a second preferred embodiment of the invention in a telescopic arrangement.
Figure 7:
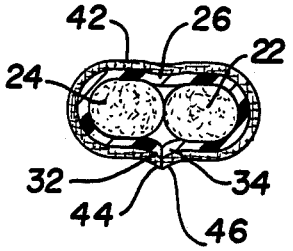
FIG. 7 is a cross sectional view of FIG. 6.

FIGS. 6 and 7 illustrate a second preferred embodiment for the present invention. As can be seen, this embodiment consists of an intermediate piece 26 in addition to rows 22 and 24 of corded fabric and an outer piece 42. The assemblage of the components of this embodiment is apparent from the description and explanation already given, and which can be best appreciated with reference to FIG. 7. The corded fabric 22, 24 is arranged into two rows. Intermediate piece 26 is wrapped around the two rows 22, 24 with the plastic covering 28 being on the outside. The longitudinal edges of intermediate piece 26 are sewn together. Wrapped around these elements is outer fabric 42 which is first sewn along its longitudinal edges to form a wrapper and then intermediate piece 26 with the corded fabric are inserted into the formed wrapper 42. The sewn longitudinal edges 32, 34 of intermediate piece 26 are caused to be in alignment with those of outer piece 42. In order to maintain this positioning, some glue or epoxy may be applied beforehand to the outer side of intermediate piece 26. Once in alignment, several rows of stitches are made along the longitudinal centerline down through to the top side of the hand-grip member 14, thereby completing the hand-grip member.

Figure 8:
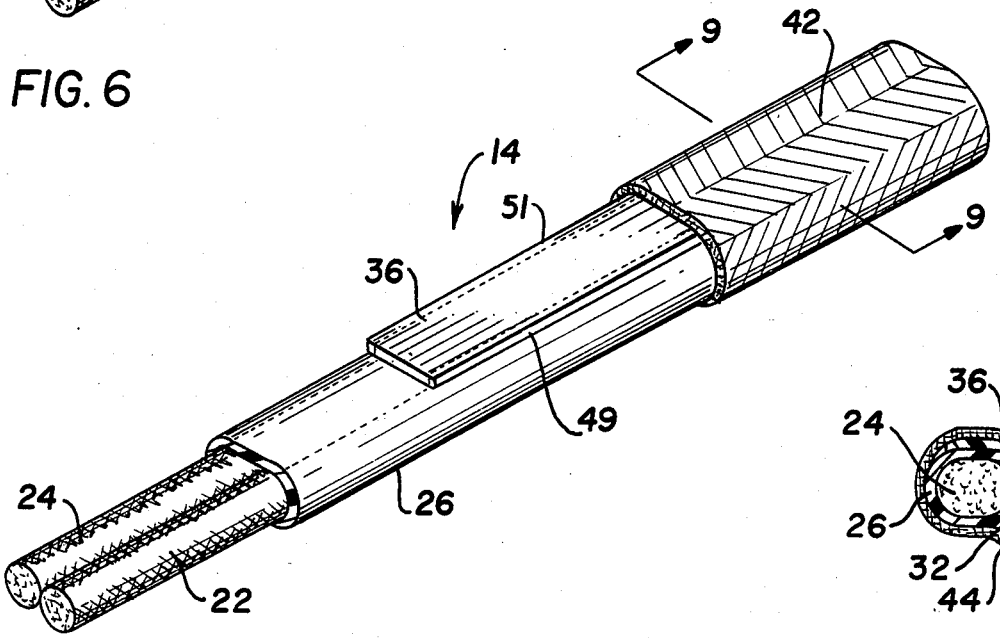
FIG. 8 is an isometric view of a third preferred embodiment for the invention in a telescopic arrangement.
Figure 9:
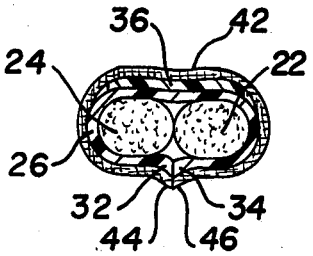
FIG. 9 is a cross-sectional view of FIG. 8.

FIGS. 8 and 9 illustrate a third embodiment of the present invention, and here again, little or no further explanation is necessary in that the embodiment constitutes those components of FIG. 3, which FIG. 3 has already been explained.

In the assembly of the components of FIGS. 8 and 9 as in the second embodiment, the two rows 22 and 24 of corded material are cut and arranged in an even length, with intermediate piece 26. Intermediate piece 26 is wrapped therearound with its longitudinal edges 32, 34 being sewn together.

Strap 36 is placed on top of the upper surface of intermediate piece 26 and then sewn along its longitudinal edges 49, 51 down through and along the two opposing longitudinal folded edges formed by the assembled corded fabric 22, 24 with intermediate piece 26. The dotted lines of FIG. 8 indicate the location for the stitches. Similarly to the second embodiment, outer fabric material 42 which may be one whole piece or two smaller identical pieces, is enwrapped around the two outward extending protrusions 56, 58 (FIG. 1) which are formed by sewing down the centerline of the assembled corded material 22, 24, intermediate piece 26, and strap 36; and affixed thereto by sewing along the centerline to form the hand-grip element 14 of the third embodiment. A decorative strip as shown in FIG. 1 can optionally be sewn along its ends through the center of hand-grip member 14.

For all three embodiments which make a hang-grip member 14, the making of a handle assembly 10 for attachment to a luggage case is as follows: the transverse opposed ends of hand-grip member 14 are evenly trimmed and plastic loops 20, 20' are juxtaposed near each of the transverse ends thereof. Each attachment tab 16, 16' is drawn through its respective loop 20, 20' until the rounded ends of attachment tab 16, 16' are brought into alignment on the top and bottom of the assembled hand-grip element 14, and sewn down through and along the periphery of attachment tab 16, 16' and its adjacent plastic loop 20, 20'. (FIGS. 1 and 2).

As to the anchoring means 18, 18' for each handle assembly 10, it consists of a generally rectangular piece of fabric material complementing or corresponding to the outer piece of material 42 for hand-grip member 14; a metal clip (not shown) and a generally rectangular piece of leather-like material 48, 48'. The metal clip is bent on itself over the side of plastic loop 20, 20' opposite the side where hand-grip member is affixed. The fabric material as shown at 50, 52 (FIG. 2) of anchoring means 18, 18' is pulled through loop 20, 20' over the metal clip until its edges are made to meet its corresponding edge. The piece of leather-like material 48, 48' is placed over the top surface of the folded fabric material and sewn thereto with the top thread being the same shade as the piece of leather-like material, and the bottom thread being the same shade as the fabric material. The metal clip of each anchoring means gives rigidity and provides a solid foundation for the insertion of fastening means, such as rivets 54, 54'. A hole is provided as by punching or drilling in anchoring means, and the anchoring tabs 18, 18' are both riveted to the wall or frame 12 of the luggage case. The anchoring means and the manner in which it is attached to the luggage case are well-known in the art.

All the fabric materials, i.e., corded rows 22, 24, intermediate piece 26, strap 36 and outer piece 42 can be pre-cut the same length prior to assemblage or can be cut from the parent coil or ream during the assemblage process. Also, the corded fabric 22, 24 can be one piece of cord folded over on itself at one end, which one can later be severed. It will be noted that in sewing the several pieces of fabric material down along a longitudinal centerline that a slight indention is formed therealong in the center with two identical protrusions 56, 58 formed alongside the indention. In the forming and sewing of the fabric materials as mentioned earlier the hand-grip member 14 is caused to assume a substantially flat disposition with the two protrusions still maintaining a definitive profile. The width of the hand-grip member is wide enough to be encircled by an average dimension hand span with the fingers conveniently being place in the indentation on the underside of hand-grip member 14.

The placement of the handle assembly 10 on the luggage case, and the flexible hand-grip member 14 permit the necessary arching away from the luggage case for easy grasping. The contour of hand-grip member 14 contributes to the ease in carrying the luggage case. The fabric materials of the hand-grip member 14 are all of a sturdy, durable nature adding long life thereto with the outer piece of fabric 42 enhancing both the beauty and durability of the luggage case.

While specific embodiments of handle assemblies are disclosed, and described herein, it will be understood that further variations therefrom are possible within the scope of the following claims.

I claim:

1. A handle assembly for a luggage case of the type in which a handgrip element is attached to the body of the luggage case, the improvement of said handgrip element comprising:

a flexible, heavy cord material formed into at least two longitudinal and closely spaced rows which provide a substantial central portion for said handgrip element, an outer piece of material having the characteristics to complement said luggage case enwrapped around said at least two rows of said cord material and having longitudinal edges secured along a longitudinal centerline of and between said at least two rows in at least said central portion which forms a pliable sturdy said central portion, said outer piece of material consisting of at least two sections, each section adapted to enwrap a different longitudinally disposed row of said cord of material, whereby the longitudinal edges of each section substantially mates with that of the other along said centerline, and means for securing said mating surfaces of each section to opposed mating surfaces along said centerline of said center portion.

2. A handle assembly for a luggage case of the type in which an elongated handgrip element is attached to the body of the luggage case, the improvement of said elongated handgrip element comprising:

a flexible, heavy cord material formed into at least two longitudinal closely spaced elongated rows extending the length of said grip element to provide a substantial foundation and central portion for said handle assembly, an intermediate material of a flexible, padded composition enwrapped around said two longitudinal rows of said cord material and having mating longitudinal edges secured together to form a seam extending along a centerline of said central portion, and an outer material enwrapped around said intermediate material and said cord material and having mating longitudinal edges secured together to form a seam extending along said centerline in said central portion of said handgrip element, said cord material, said intermediate material and said outer material being substantially the same length compressed together in a flattened disposition forming a gripping surface area having contoured protrusion areas along opposite sides of said centerline of said handgrip element.

3. A handle assembly according to claim 2, wherein said handgrip element has two opposed longitudinal ends and further comprising:

means for securing each said opposed end to said body of said luggage case, including loop means, and a flap material extending through said loop means with its ends folded over itself to substantially enwrap its cooperative opposed end of said handgrip element and means for attaching said flap material to its said cooperative end of said handgrip element to secure said loop means thereto.

4. A handle assembly according to claim 2, wherein said two rows of said cord material being disposed relative to each other to form a substantial supporting surface, with a nonsupporting area therebetween and further comprising an elongated flexible strap material being of a length substantially equalling that of said elongated handgrip element disposed along said supporting surface over said nonsupporting area formed by said two rows of said cord material to increase the rigidity of said central portion.

5. A handle assembly according to claim 2, further comprising a decorative narrow band of fibrous material extending along said centerline secured to at least said outer material on its surface opposite to its surface adjacent said luggage case.

6. A handle assembly according to claim 4, further comprising means for said securing of said outer and intermediate pieces to said cord of material including a combination of stitches and a glue substance.

* * * * *

UNITED STATES PATENT AND TRADEMARK OFFICE

CERTIFICATE OF CORRECTION

PATENT NO. : 4,696,077

DATED : September 29, 1987

INVENTOR(S) : Hyun S. Kim

It is certified that error appears in the above-identified patent and that said Letters Patent is hereby corrected as shown below:

Column 1, line 41, "hang-grip" should be --hand-grip--.

Column 4, line 7, "hang-grip" should be --hand-grip--.

Column 5, line 31, "center" should be --central--.

Signed and Sealed this

Second Day of February, 1988

*Attest:*

DONALD J. QUIGG

*Attesting Officer*

*Commissioner of Patents and Trademarks*